US008973996B2

(12) United States Patent
Daghistani

(10) Patent No.: US 8,973,996 B2
(45) Date of Patent: Mar. 10, 2015

(54) CONGREGATIONAL PRAYER CHAIR

(71) Applicant: King Abdulaziz University, Jeddah (SA)

(72) Inventor: Farouk Fouad Daghistani, Jeddah (SA)

(73) Assignee: King Abdulaziz University, Jeddah (SA)

( * ) Notice: Subject to any disclaimer, the term of this patent is extended or adjusted under 35 U.S.C. 154(b) by 66 days.

(21) Appl. No.: 13/743,093

(22) Filed: Jan. 16, 2013

(65) Prior Publication Data

US 2014/0197669 A1 Jul. 17, 2014

(51) Int. Cl.

| | |
|---|---|
| ***A47C 1/00*** | (2006.01) |
| ***A47C 1/032*** | (2006.01) |
| ***A47C 15/00*** | (2006.01) |

(52) U.S. Cl.

CPC ..... *A47C 1/032* (2013.01); *A47C 15/004* (2013.01)

USPC ..... 297/322; 297/316; 297/324; 297/340

(58) Field of Classification Search

USPC ..... 297/19, 27, 29, 316, 322, 324, 340

See application file for complete search history.

(56) References Cited

U.S. PATENT DOCUMENTS

| | | | | |
|---|---|---|---|---|
| 1,189,178 | A | 6/1916 | Severin | |
| 1,326,417 | A | 12/1919 | Paine | |
| 1,411,747 | A | 4/1922 | Samter et al. | |
| 2,470,364 | A * | 5/1949 | Niederhauser | 297/316 |
| 2,747,653 | A * | 5/1956 | Obradovich | 297/29 |
| 4,218,089 | A | 8/1980 | Beltrami et al. | |
| 4,547,017 | A * | 10/1985 | Lescure | 297/318 |
| 5,660,439 | A * | 8/1997 | Unwalla | 297/316 |
| 5,785,384 | A * | 7/1998 | Sagstuen | 297/317 |
| 6,439,661 | B1 * | 8/2002 | Brauning | 297/300.2 |
| 6,641,214 | B2 * | 11/2003 | Veneruso | 297/322 |
| 7,735,925 | B2 * | 6/2010 | Lin | 297/317 |
| 2009/0195040 | A1 | 8/2009 | Birkbeck | |

* cited by examiner

*Primary Examiner* — Philip Gabler
(74) *Attorney, Agent, or Firm* — Richard C Litman

(57) ABSTRACT

The congregational prayer chair is designed to provide needed support for certain worshipers participating in Muslim prayer services. The chair is constructed with a seat and seat-back supported between two connecting arms. The connecting arms are mounted on chair legs. Grooves and tracks are provided on the arms that permit the seat and the seat-back to be moved in a predetermined manner so that a worshiper can attain the required prayer positions without disturbing the alignment of the prayer rows and the other worshippers.

17 Claims, 6 Drawing Sheets

CONGREGATIONAL PRAYER CHAIR

BACKGROUND OF THE INVENTION

1. Field of the Invention

The present invention generally relates to furniture construction, and particularly to a congregational prayer chair constructed and designed to accommodate Muslim worshipers performing congregational prayers in mosques.

2. Description of the Related Art

Muslims are required to pray five times a day. These prayers are usually performed by millions of worshipers in mosques around the world. The worshipers are required to arrange themselves in compact, straight and parallel rows with no gaps in the rows. Participants are required to attain a particular set of body positions while performing the prayers. These positions consist of standing, bowing, prostrating, and sitting on the ground or floor for long and short periods of time. Unfortunately, because of age, illness, pregnancy, etc., many worshipers cannot assume all of the required body positions and must rely on a support structure (usually a conventional chair) for assistance in attaining the positions that they cannot assume or find difficult to assume.

It has been determined through observation that chair users can be classified into five basic categories: Category 1, uses chairs to perform all praying positions; Category 2, uses chairs in all praying positions, except the standing position; Category 3, uses chairs in all positions, except the standing and bowing positions; Category 4, uses chairs only for the long sitting position; Category 5, may use the chair for any position if fatigued. Placement of the chair's front and/or rear legs relative to a row will depend on the particular category, wherein either the front legs or the rear legs are aligned with the row. Unfortunately, both positions have disadvantages, since they may cause the worshiper to be in misalignment with the row in some of the prayer positions. Millions of Muslim worshipers would welcome a chair designed to alleviate the misalignment problems and still provide adequate support to attain all of the required prayer positions. Thus, a congregational prayer chair solving the aforementioned problems is desired.

SUMMARY OF THE INVENTION

The congregational prayer chair is a chair designed to provide needed support for certain worshipers participating in Muslim prayer services. The chair is constructed with a seat and a seat back supported between two connecting arms. The connecting arms are mounted on chair legs. Grooves and tracks are provided on the arms that permit the seat and the seat back to be moved in a predetermined manner.

Accordingly, the invention presents a chair that would permit a worshiper to attain the five prayer positions without changing the placement of the legs of the chair, and thus not disturb the alignment of the row and not disturb the worshipers in the row behind the chair. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 5:
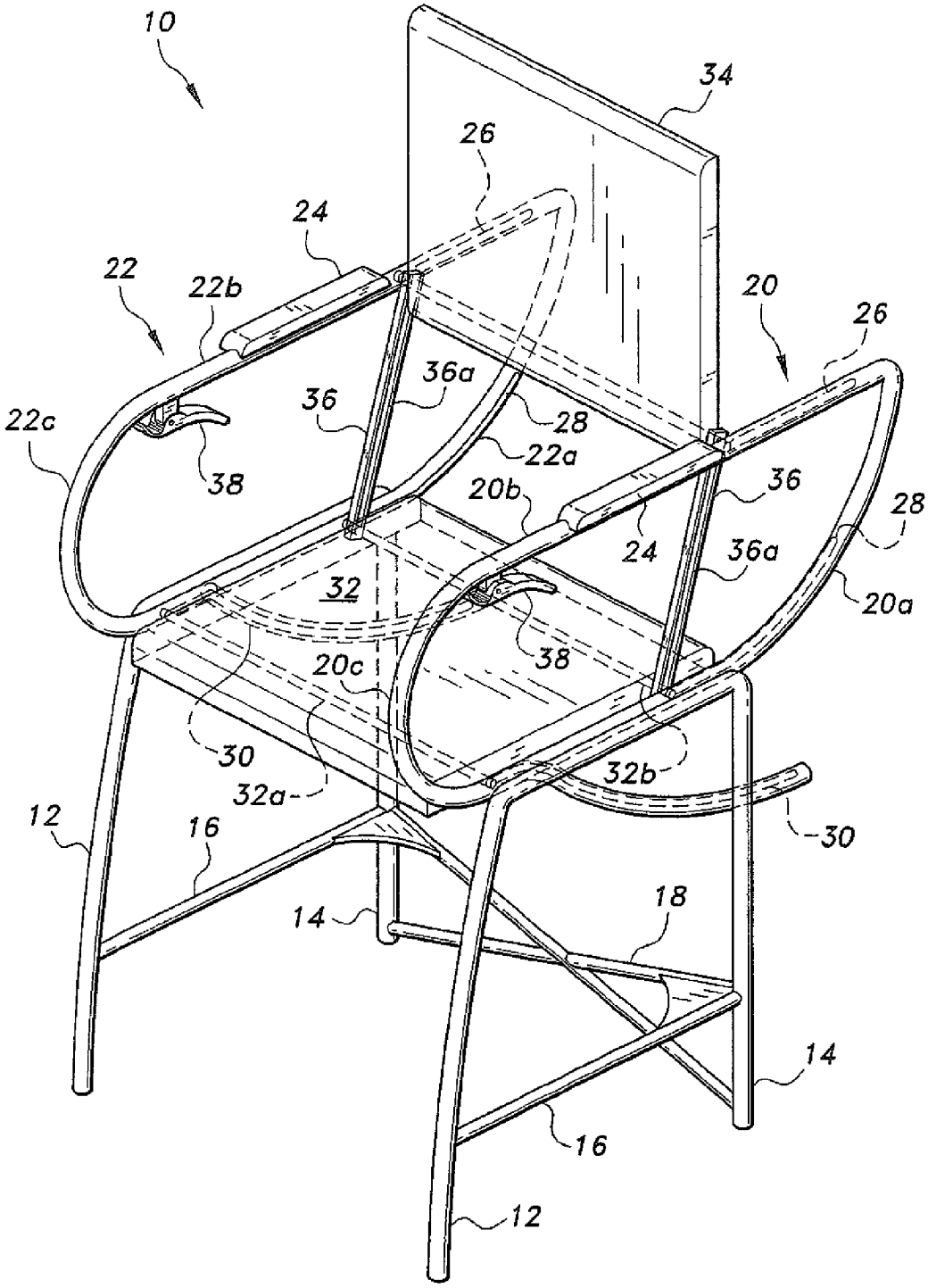
FIG. 5 is a perspective view of a congregational prayer chair according to the present invention.
Figure 6:
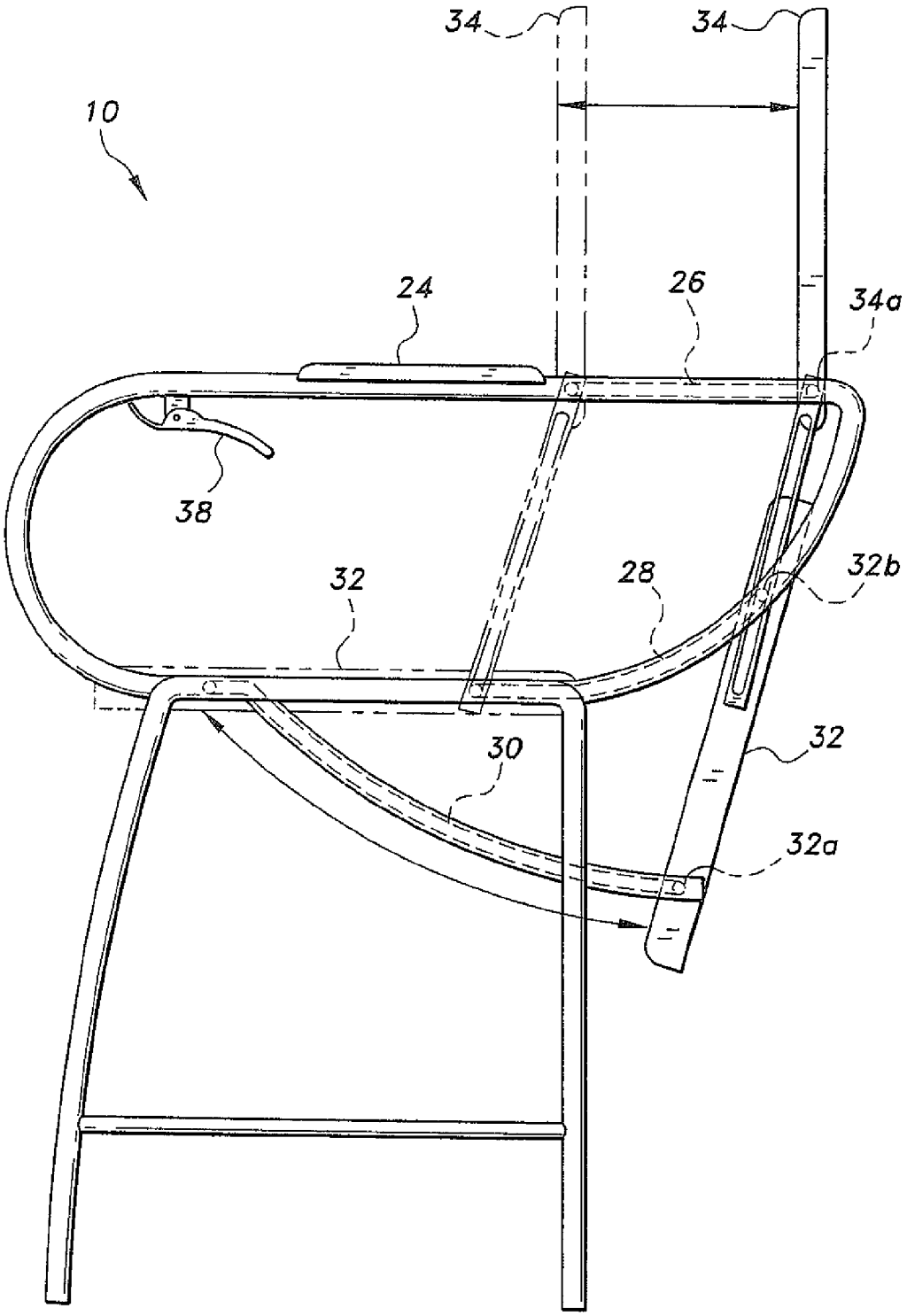
FIG. 6 is a side view of the congregational prayer chair of FIG. 5, showing the movable seat and back positions.

Referring to FIGS. 5 and 6, the congregational prayer chair 10 comprises a pair of U-shaped leg members that form spaced-apart front and rear legs 12 and 14. A pair of support bars 16 spans the distance between and connects the front legs 12 to the rear legs 14. Support bars 18 that crisscross diagonally in X-shaped fashion connect the rear legs to each other. The support bars 18 function to add rigidity and stability to the chair 10. Respective arm supports 20, 22 are attached to the inner surface of each respective U-shaped leg member.

Each arm support 20, 22 is fashioned with a respective curved rear portion 20*a*, 22*a* for reasons that will be explained below. Respective straight portions 20*b*, 22*b*, extend from each curved rear portion to respective front curved portions 20*c*, 22*c* to define the arm supports. Cushioning pads 24 are mounted on the upper surfaces of the respective support arms 20, 22. The support arms 20, 22 have inner surfaces that are provided with grooves or tracks therein, forming upper tracks 26 and lower tracks 28. Additional track members 30 extend angularly and rearward from the arm supports 20, 22.

A seat member 32 and a seat back 34 are disposed between the arm supports 20, 22. The seat member 32 has front pins 32*a* and rear pins 32*b* attached at each side thereof (only one side shown). The front pins 32*a* are engaged in the track members 30 for sliding movement therein, The rear pins 32*b* are engaged in the track 28 for sliding movement therein. The seat back 34 is provided with a pin 34*a* extending from each side thereof (only one side shown) for respective engagement in the upper tracks 26. A respective connecting arm 36 extends between the seat back 34 and the seat 32 on each side of the chair 10. A slot 36*a* is provided along the length of each connecting arm 36. At its upper end, each connecting arm 36 is interposed between the seat back 34 and the respective curved portions 20*a*, 22*a* of the support arms 20 and 22 and is mounted for pivotal movement on the pins 34*a*. At its lower end, each of the respective connecting arms 36 is interposed between the seat member 32 and the curved portion 20*a*, 22*a* of the support arms 20 and 22. Each rear seat pin 32*b* is mounted for sliding movement in each corresponding slot 36*a*. As best seen in FIG. 6, the seat member 32 and the seat back 34 can assume one of two positions, a forward position (shown in phantom lines) and a rearward position (shown in solid lines). The seat and seat back can be locked in either position by a conventional locking mechanism. Handles 38 interact with the locking mechanism to release the seat 32 and seat back 34 for movement, when desired.

Figure 1:
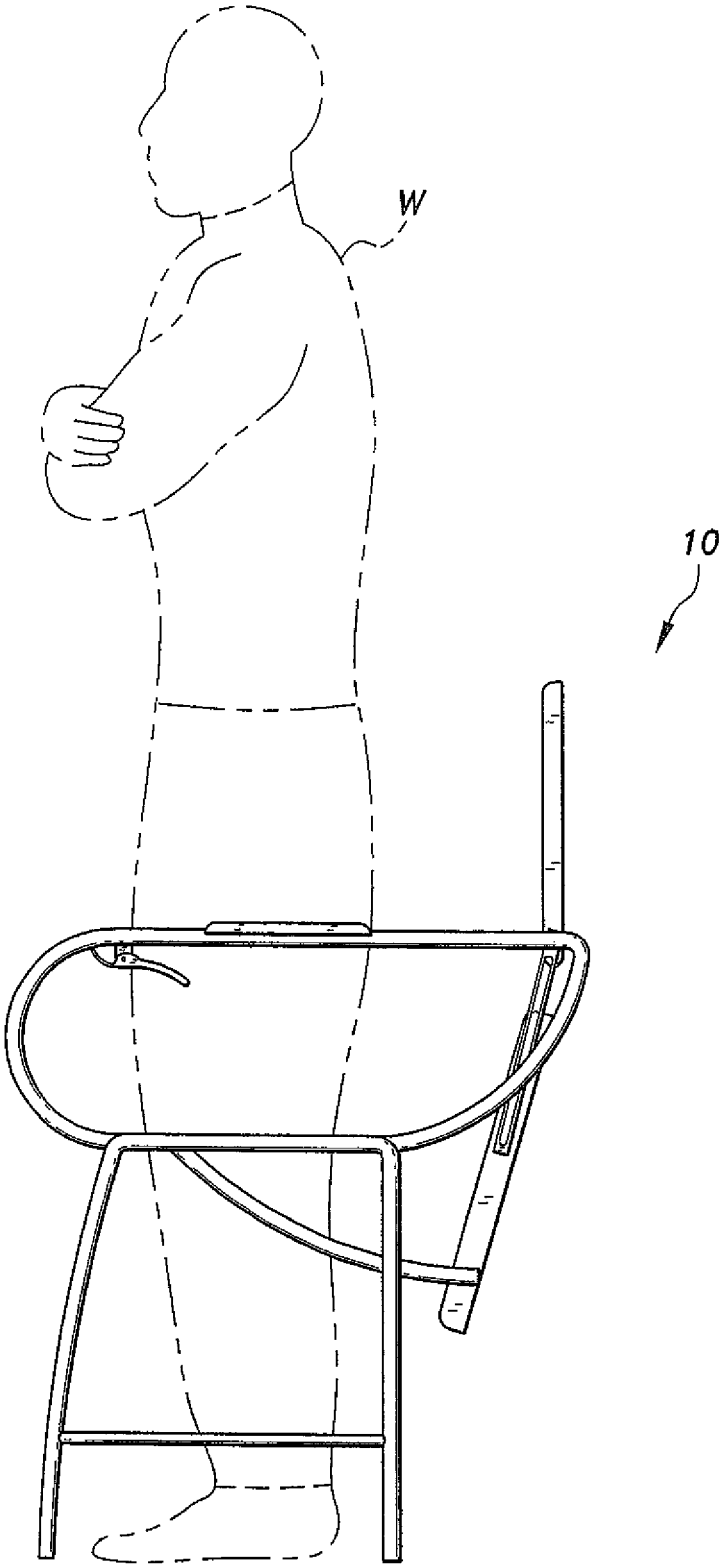
FIG. 1 is an environmental side view of a congregational prayer chair according to the present invention, shown when used in the standing prayer position.
Figure 2:
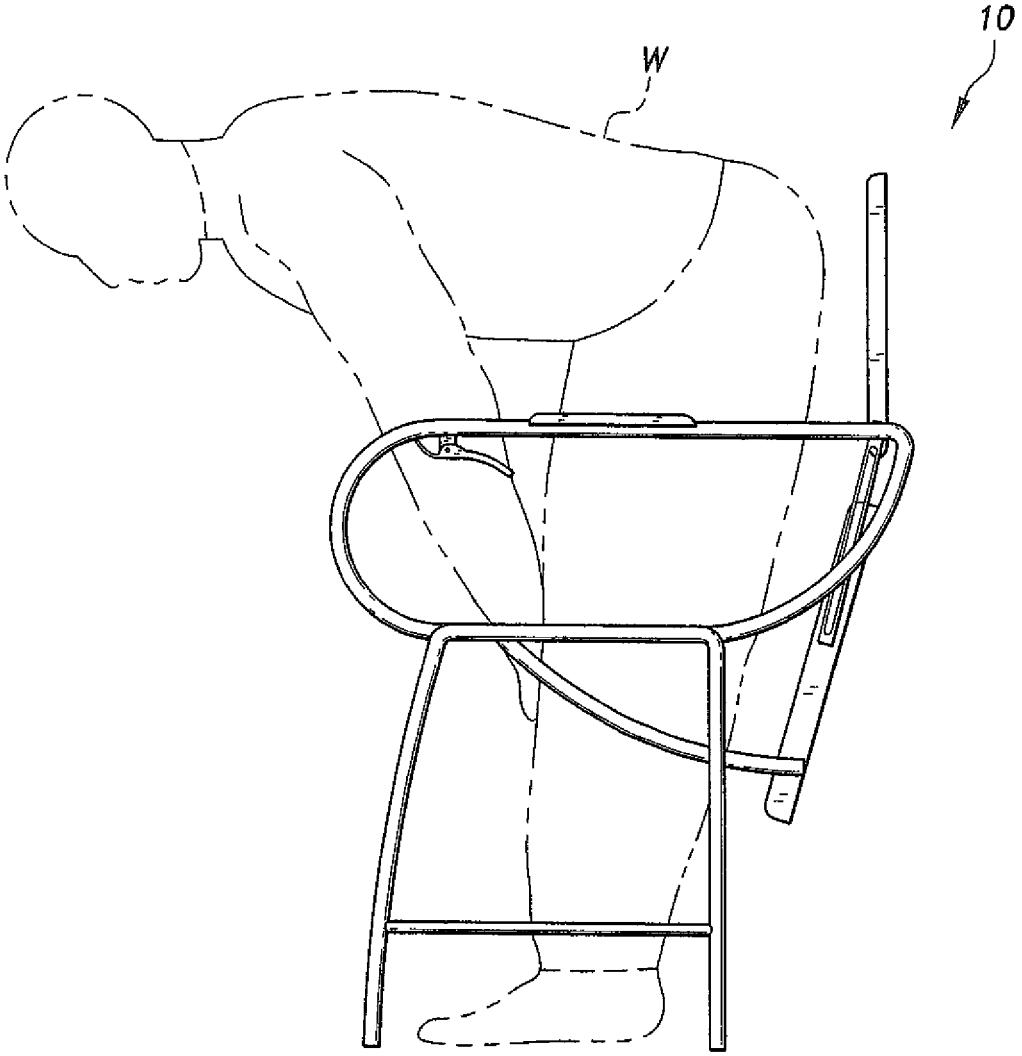
FIG. 2 is an environmental side view of a congregational prayer chair according to the present invention, shown when used in the bowing prayer.
Figure 3:
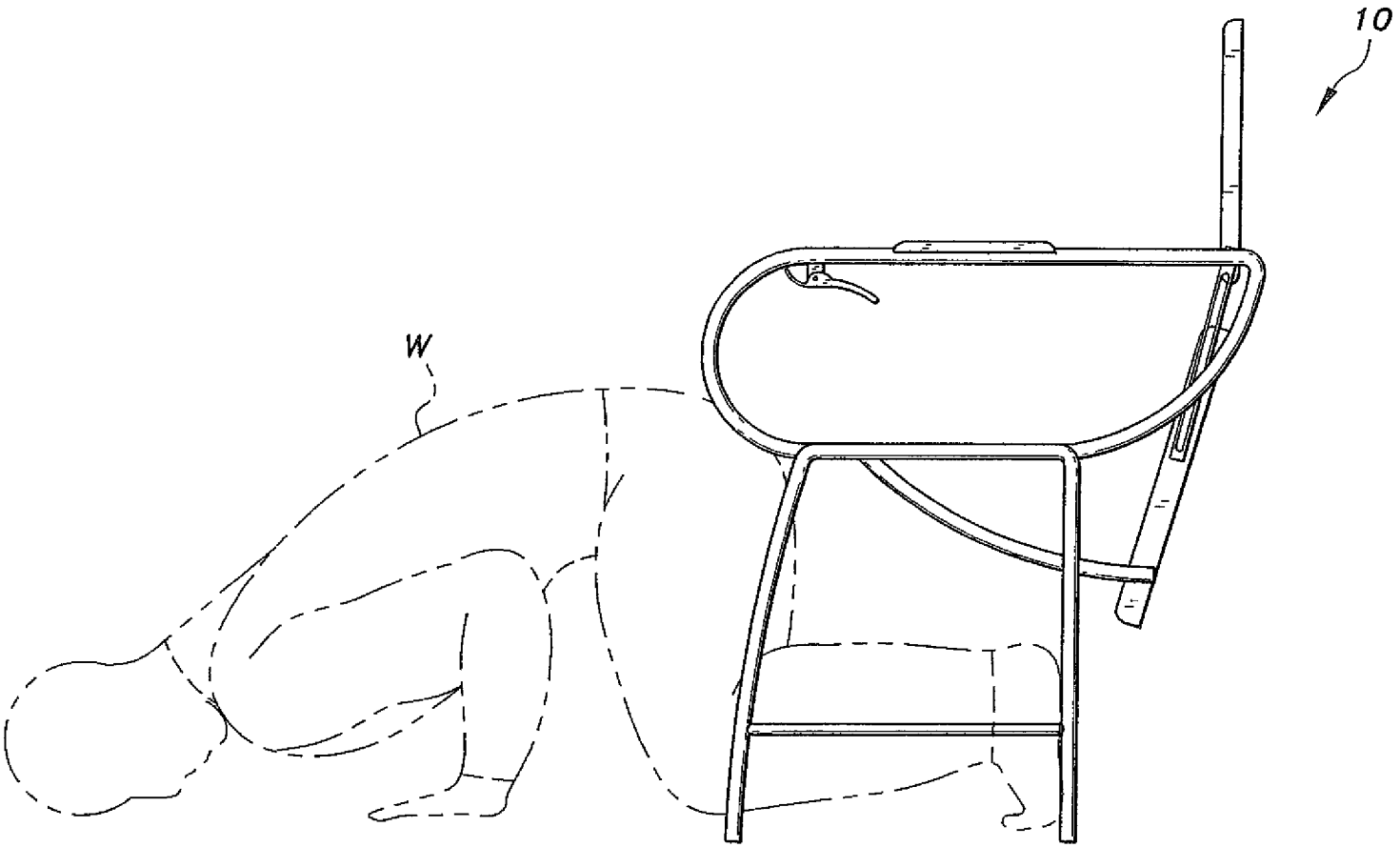
FIG. 3 is an environmental side view of a congregational prayer chair according to the present invention, shown when used in the prostrate prayer position.
Figure 4:
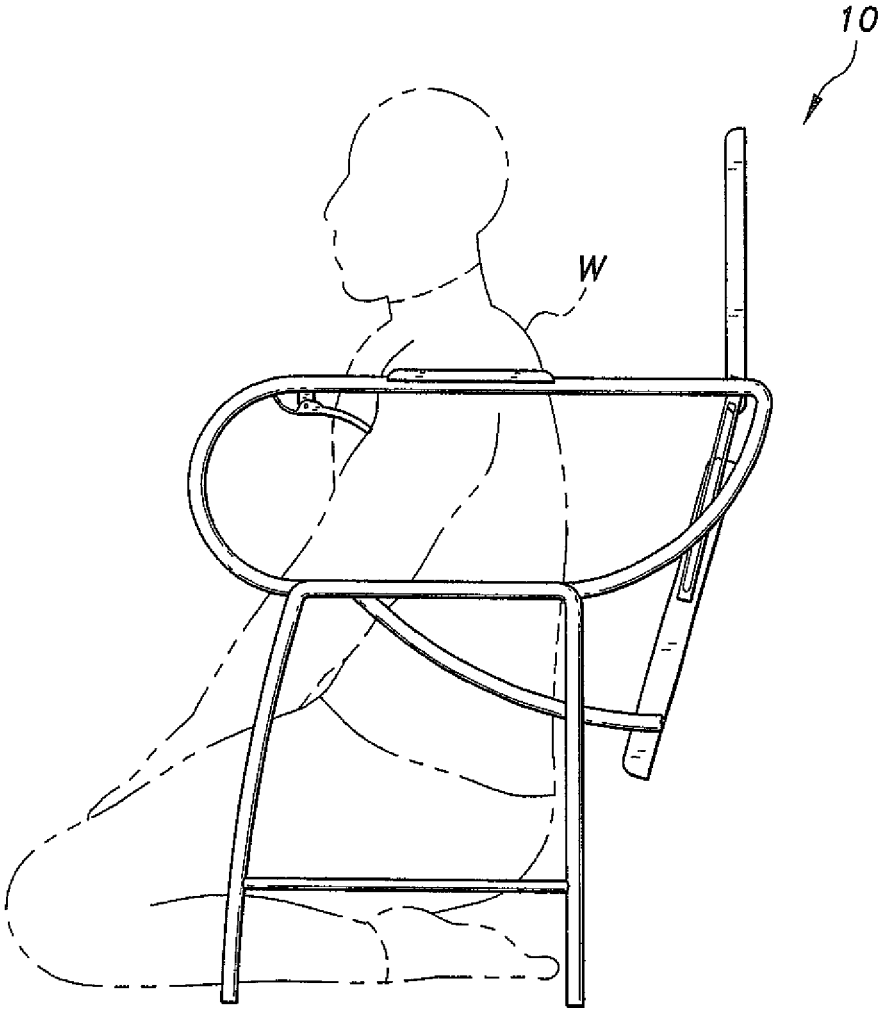
FIG. 4 is an environmental side view of a congregational prayer chair according to the present invention, shown when used in the sitting prayer position.

In the forward position, the chair 10 functions as a conventional chair and may be employed in this position by worshipers whose age and/or disabilities require the use of a conventional chair. In the rearward position, the seat 32 and the seat back 34 are moved rearward, and the seat 32 swings down to provide open space (approximately 50-60 cm.) between the arm supports 20, 22. The rearward position allows worshipers W who are physically able to do so to attain the standing position (FIG. 1), the bowing position (FIG. 2), the prostrate position (FIG. 3) or the sitting position (FIG. 4) without moving the legs of the chair, thus retaining the alignment of the rows and without disturbing the worshipers in the row behind the chair 10.

It is to be understood that the present invention is not limited to the embodiments described above, but encompasses any and all embodiments within the scope of the following claims.

I claim:

1. A congregational prayer chair, comprising:

a pair of U-shaped members, the U-shaped members being spaced apart to define a pair of front legs and a pair of rear legs;

a respective arm support attached to each of the U-shaped members, each of the arm supports having an inner surface;

a chair seat disposed substantially horizontal between the respective arm supports, the chair seat being mounted on the arm supports for sliding and pivotal movement thereon;

the chair seat having a forward end and a rearward end, the rearward end being adjacent the rear legs;

wherein the sliding and pivotal movement of the chair seat is a selective articulation downwardly of the forward end and away from the horizontal position to a substantially vertical position; and a seat back disposed between the arm supports, the seat back being mounted on the arm supports for sliding movement thereon.

2. The congregational prayer chair according to claim 1, further including reinforcing support bars connecting said pair of front legs to said pair of rear legs.

3. The congregational prayer chair according to claim 1, further including reinforcing support bars crisscrossed in an X-shape connecting said pair of rear legs.

4. The congregational prayer chair according to claim 1, further including a respective arm support pad disposed on each of said arm supports.

5. The congregational prayer chair according to claim 1, wherein said spaced apart distance is between 50-60 cm.

6. A congregational prayer chair, comprising:

a pair of U-shaped members, the U-shaped members being spaced apart a distance to define front and rear legs;

a respective arm support attached to each of the U-shaped members, each of the arm supports having an inner surface, a lower track formed in the inner surface, and an upper track formed in the inner surface;

an additional track member extending downward from each of the arm supports;

a chair seat disposed between the respective arm supports and mounted for sliding and pivotal movement thereon, the chair seat having two sides thereon;

respective front and rear pins extending from each side of the chair seat, the front pins defining a front portion of the chair seat, and the rear pins defining a rear portion of the chair seat;

wherein the front portion of the chair seat is a selectively articulated downward and away from a substantially horizontal position into a substantially vertical position by the sliding and pivotal movement; and a seat back disposed between the arm supports and mounted for sliding movement thereon, the seat back having two sides thereon and a respective seat back pin extending from each of the sides of the seat back.

7. The congregational prayer chair according to claim 6, wherein the front pins of the chair seat are respectively engaged in each of the additional track members.

8. The congregational prayer chair according to claim 6, wherein the rear pins of the chair seat are respectively engaged in each of the lower tracks.

9. The congregational prayer chair according to claim 6, wherein each of the seat back pins is engaged in the respective upper track.

10. The congregational prayer chair according to claim 6, further including reinforcing support bars connecting said pair of front legs to said pair of rear legs.

11. The congregational prayer chair according to claim 6, further including reinforcing support bars crisscrossed in an X-shape connecting said pair of rear legs.

12. The congregational prayer chair according to claim 6, further including a respective arm support pad disposed on each of said arm supports.

13. The congregational prayer chair according to claim 6, wherein the spaced apart distance is between 50-60 cm.

14. A congregational prayer chair, comprising:

a pair of U-shaped members, the U-shaped members being spaced apart a distance of between 50-60 cm to define a pair of front legs and a pair of rear legs;

reinforcing support bars connecting the pair of front legs to the pair of rear legs;

reinforcing support bars crisscrossed in an X-shape connecting the pair of rear legs;

a respective arm support attached to each of the U-shaped members, each of the arm supports having an inner surface, a lower track formed in the inner surface, and an upper track formed in the inner surface;

an additional track member extending downward from each of the arm supports;

a respective arm support pad disposed on each of the arm supports;

a chair seat disposed between the respective arm supports and mounted for sliding and pivotal movement thereon, for selectively moving the chair seat from a substantially horizontal position to a substantially vertical position in a downward and backward direction, the chair seat having two sides thereon;

respective front and rear pins extending from each of the sides of the chair seat, the front pins defining a front portion of the chair seat, and the rear pins defining a rear portion of the chair seat;

wherein the front portion of the chair seat is selectively moved downwardly when the chair seat is selectively pivotally moved from a substantially horizontal position to a substantially vertical position;

a seat back disposed between the arm supports and mounted for sliding movement thereon, the seat back having two sides thereon and a respective seat back pin extending from each of the sides of the seat back;

wherein the seat back is adjacent to the rear portion of the chair seat; and a respective handle disposed on each of the arm supports for releasing the seat and the seat back for movement.

15. The congregational prayer chair according to claim 14, wherein the front pins of the chair seat are respectively engaged in each of the additional track members.

16. The congregational prayer chair according to claim 15, wherein the rear pins of the chair seat are respectively engaged in each of the lower tracks.

17. The congregational prayer chair according to claim 16, wherein each of the seat back pins is engaged in the respective upper track.

* * * * *